US006195990B1

(12) United States Patent
Machesney et al.

(10) Patent No.: US 6,195,990 B1
(45) Date of Patent: Mar. 6, 2001

(54) HYDRAULIC MACHINE COMPRISING DUAL GEROTORS

(75) Inventors: Kerry A. Machesney, Centerville; John S. Hill; Michael J. Mientus, both of Dayton, all of OH (US)

(73) Assignee: Valeo Electrical Systems, Inc., Auburn Hills, MI (US)

( * ) Notice: Subject to any disclaimer, the term of this patent is extended or adjusted under 35 U.S.C. 154(b) by 0 days.

(21) Appl. No.: 09/231,344

(22) Filed: Jan. 13, 1999

(51) Int. Cl.[7] ..... F16D 31/04; F01P 7/04; F04B 35/01; F03C 2/08

(52) U.S. Cl. ..... 60/456; 123/41.12; 417/326; 417/405; 418/171

(58) Field of Search ..... 418/6, 10, 166, 418/171, 209; 123/41.12; 60/456; 417/326, 375, 405

(56) References Cited

U.S. PATENT DOCUMENTS

| | | | | |
|---|---|---|---|---|
| 1,389,189 | * | 8/1921 | Feuerheerd | 418/166 |
| 1,968,113 | * | 7/1934 | Weaver | 418/171 |
| 3,547,565 | | 12/1970 | Eddy | 418/171 |
| 3,910,733 | * | 10/1975 | Grove | 418/166 |
| 4,189,919 | * | 2/1980 | Goscenski, Jr. | 60/456 |
| 4,504,202 | | 3/1985 | Saegusa | 418/150 |
| 4,518,332 | | 5/1985 | Saegusa | 418/150 |
| 4,657,492 | | 4/1987 | Saegusa | 418/150 |
| 4,658,583 | * | 4/1987 | Shropshire | 418/10 |
| 4,673,342 | | 6/1987 | Saegusa | 418/150 |
| 4,718,378 | | 1/1988 | Child | 123/41.12 |
| 5,165,377 | * | 11/1992 | Hosseini | 123/41.12 |
| 5,315,829 | * | 5/1994 | Fischer | 60/456 |
| 5,535,845 | | 7/1996 | Buschur | 180/417 |
| 5,561,978 | | 10/1996 | Buschur | 60/424 |
| 5,960,628 | * | 10/1999 | Machesney et al. | 60/456 |

FOREIGN PATENT DOCUMENTS

| | | | | |
|---|---|---|---|---|
| 3432704 | * | 3/1986 | (DE) | 418/171 |
| 295 21 598 | | 3/1998 | (DE) . | |
| 0811765 | | 12/1997 | (EP) . | |
| 2062187 | * | 5/1981 | (GB) | 60/456 |
| 2110759 | * | 6/1983 | (GB) | 418/171 |
| 62-20682 | * | 1/1987 | (JP) | 418/171 |
| WO 86/04638 | | 8/1986 | (WO) . | |

* cited by examiner

*Primary Examiner*—John J. Vrablik
(74) *Attorney, Agent, or Firm*—Jacox, Meckstroth & Jenkins

(57) ABSTRACT

A hydraulic machine of the gerotor type. The machine uses two gerotors which are preferably coplanar, and positioned nearly concentric to each other. This dual arrangement approximately doubles the displacement of hydraulic fluid per revolution, compared with a single gerotor, and thus doubles power transfer. Yet the housing containing the gerotors need only be large enough to contain the larger gerotor.

10 Claims, 14 Drawing Sheets

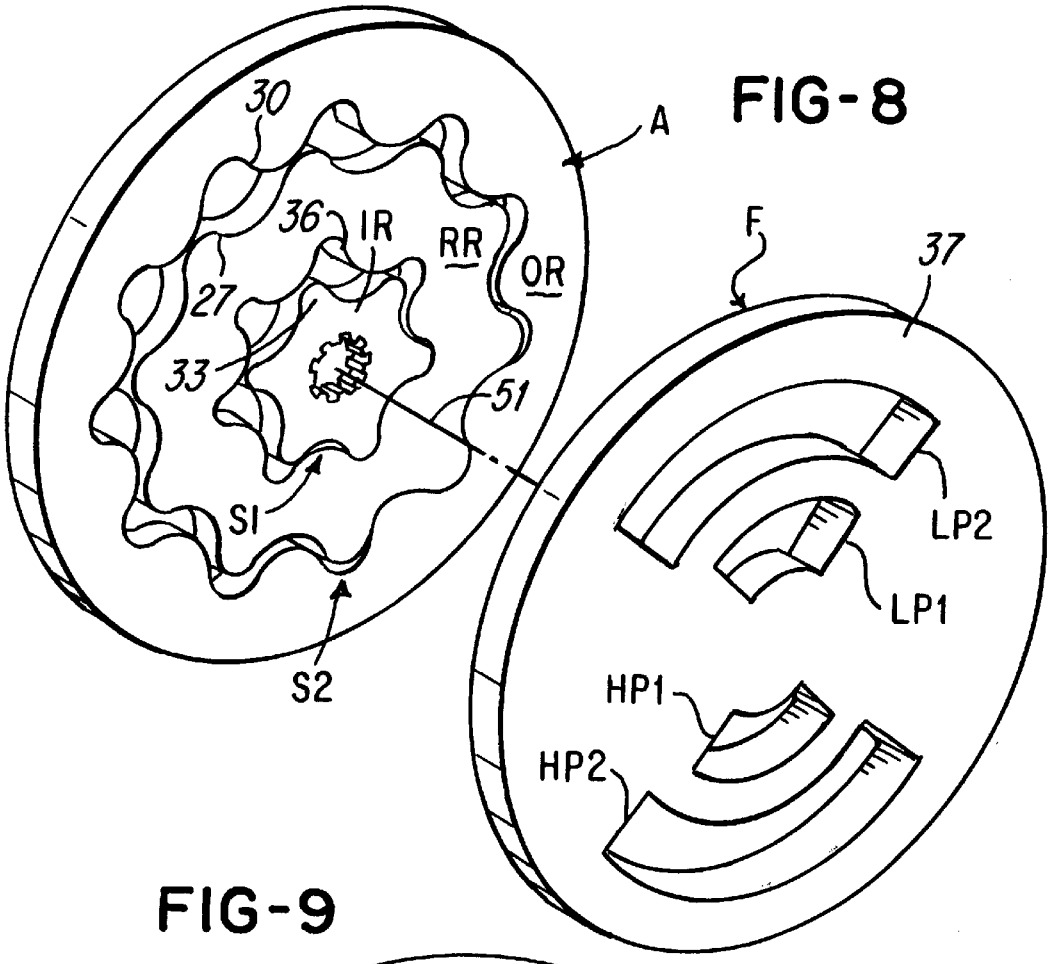
FIG-8
FIG-9
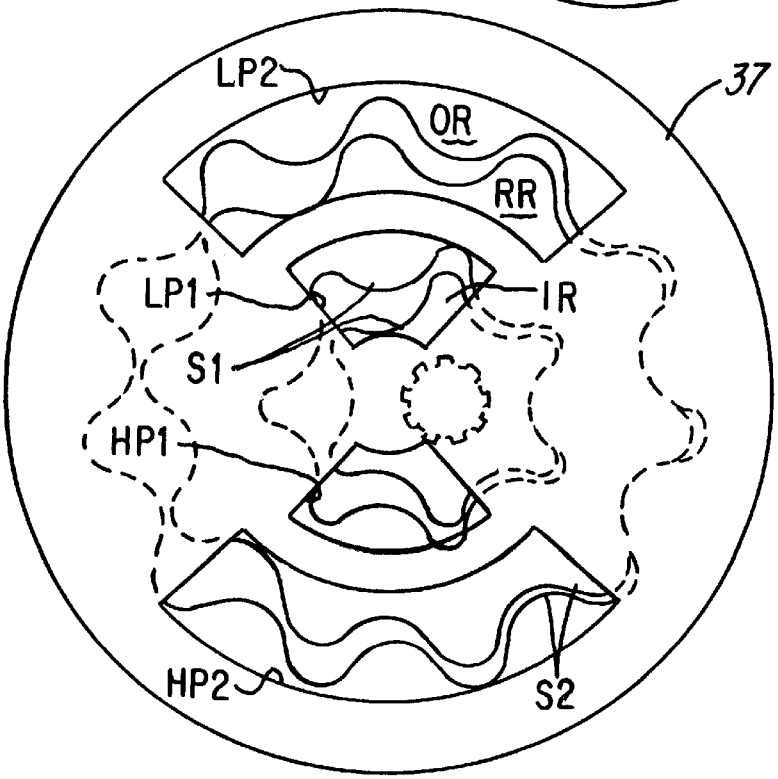

HYDRAULIC MACHINE COMPRISING DUAL GEROTORS

The invention concerns a dual-rotor gerotor machine. All rotors are placed in a single plane. This arrangement succeeds in placing the gerotors in a housing of small axial length, yet causing them to provide a large displacement of hydraulic fluid per revolution. This arrangement provides large horsepower in a small package.

BACKGROUND OF THE INVENTION

FIG. 1 illustrates a hydraulic machine 2 of the gerotor type, found in the prior art. A shaft (not shown) engages splines 9, and rotates rotor 6. The machine 2 can operate either as a pump or motor, but since operation as a pump is perhaps easier to understand, the explanation will be framed in terms of a pump. Plates such as plate 18 in FIG. 7 seal the chambers 3 and 12 in FIG. 2, which are described below.

In FIG. 2, rotor 6 rotates about center CA, as indicated by the arrow pointing to that center. Rotor R rotates about center CB, as indicated by the arrow. The distance between centers CA and CB is defined as the "eccentricity" of the two rotors.

FIGS. 3–6 illustrate these two rotations. FIG. 3 illustrates the starting position. Dots D1 and D2 have been added for reference. In FIG. 4, rotor 6 has been rotated counter-clockwise by the shaft (not shown) through about 20 degrees. The other rotor R is carried along, but not through a full 20 degrees (because the tooth ratio between the rotors is 6/7). Chamber CH1 has been reduced in volume, thereby causing fluid to become expelled through conduits which are not shown.

In FIG. 5, rotor 6 has been further rotated another 20 degrees counter-clockwise. Rotor R is again carried along, but not the full 20 degrees, and chamber CH1 is further reduced in volume.

In FIG. 6, rotor 6 has been further rotated another 20 degrees, for a total of 60 degrees, compared with FIG. 3. Rotor R is carried along, but, again, not by the full 20 degrees. Now a visible separation SEP between dots D1 and D2 begins to appear, indicating the lag of rotor R behind rotor 6. Chamber CH1 is almost compressed to zero volume.

When the machine operates as a motor, the opposite sequence occurs: pressurized fluid delivered to chambers such as CH1 forces the chambers to expand, thereby inducing rotation of both rotors 6 and R about their respective centers CA and CB.

OBJECTS OF THE INVENTION

An object of the invention is to provide an improved hydraulic machine.

A further object of the invention is to provide a dual gerotor hydraulic machine in which all gerotors occupy a single plane.

SUMMARY OF THE INVENTION

In one form of the invention, a first gerotor set is coplanar with a second gerotor set, and the second set surrounds the first.

BRIEF DESCRIPTION OF THE DRAWINGS

FIG. 8 illustrates one form of the invention.

FIG. 9 is a plan view of one form of the invention.

DETAILED DESCRIPTION OF THE INVENTION

Figure 1:
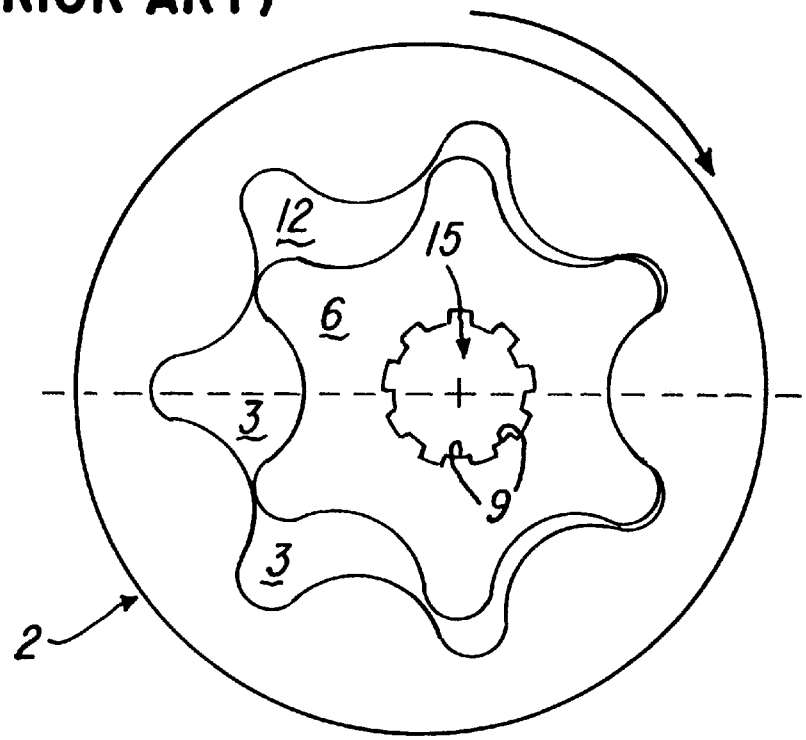
FIG-1 (PRIOR ART)
FIGS. 1 and 2 illustrate a prior-art hydraulic machine 2, of the internal gear, one-tooth difference type.
Figure 2:
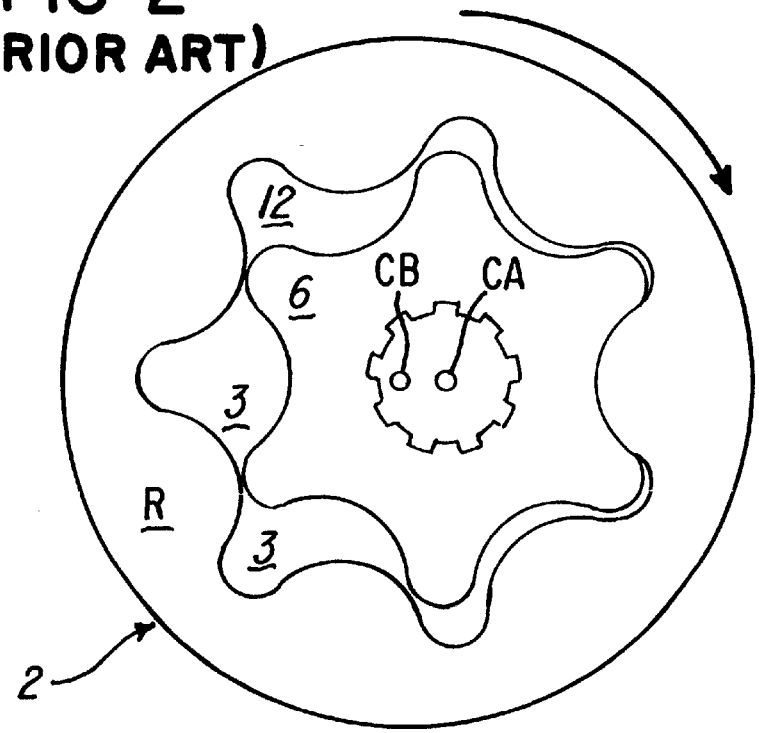
FIG-2 (PRIOR ART)
Figure 3:
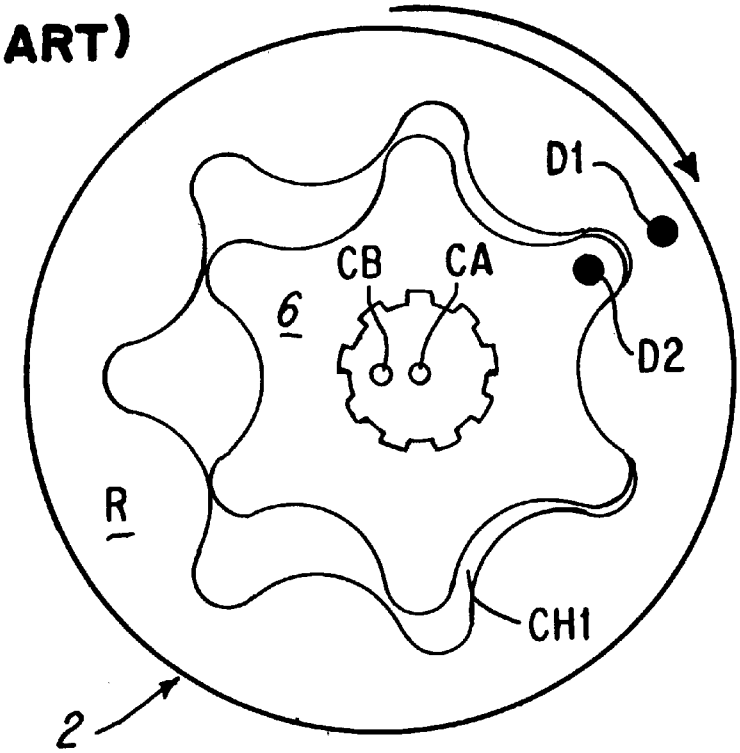
FIG-3 (PRIOR ART)
FIGS. 3–6 illustrate a sequence of events occurring during rotation of motor 2 of FIG. 1.
Figure 4:
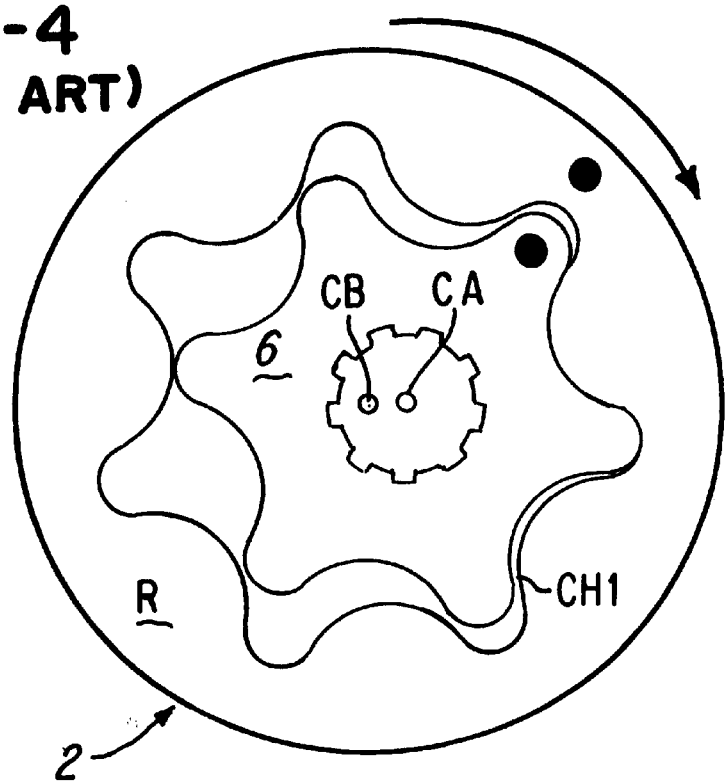
FIG-4 (PRIOR ART)

FIG. 8 illustrates one form of the invention, comprising an inner rotor IR, a ring rotor RR, and an outer rotor OR. Two gear sets, or sections, are present. The outer gear 33 of inner rotor IR and the inner gear 36 of ring rotor RR cooperate to form a first gear set S1, or first gerotor pair. The outer gear 27 of ring rotor RR and the inner gear 30 of outer rotor OR cooperate to form a second gear set S2, or second gerotor pair.

Both gear sets are shown as one-tooth difference type, but that type is not considered essential. Each gear set operates as a separate, though linked, hydraulic motor, or pump, depending on the mode of operation chosen.

A plate 37 contains ports HP1, HP2, LP1, and LP2, which deliver fluid to the two gear sets. FIG. 9 illustrates the plate 37 in plan view. Two high-pressure ports, HP1 and HP2, deliver fluid to respective gear sets S1 and S2. Two low-pressure ports, LP1 and LP2, exhaust fluid from the respective gear sets S1 and S2.

Figure 10:
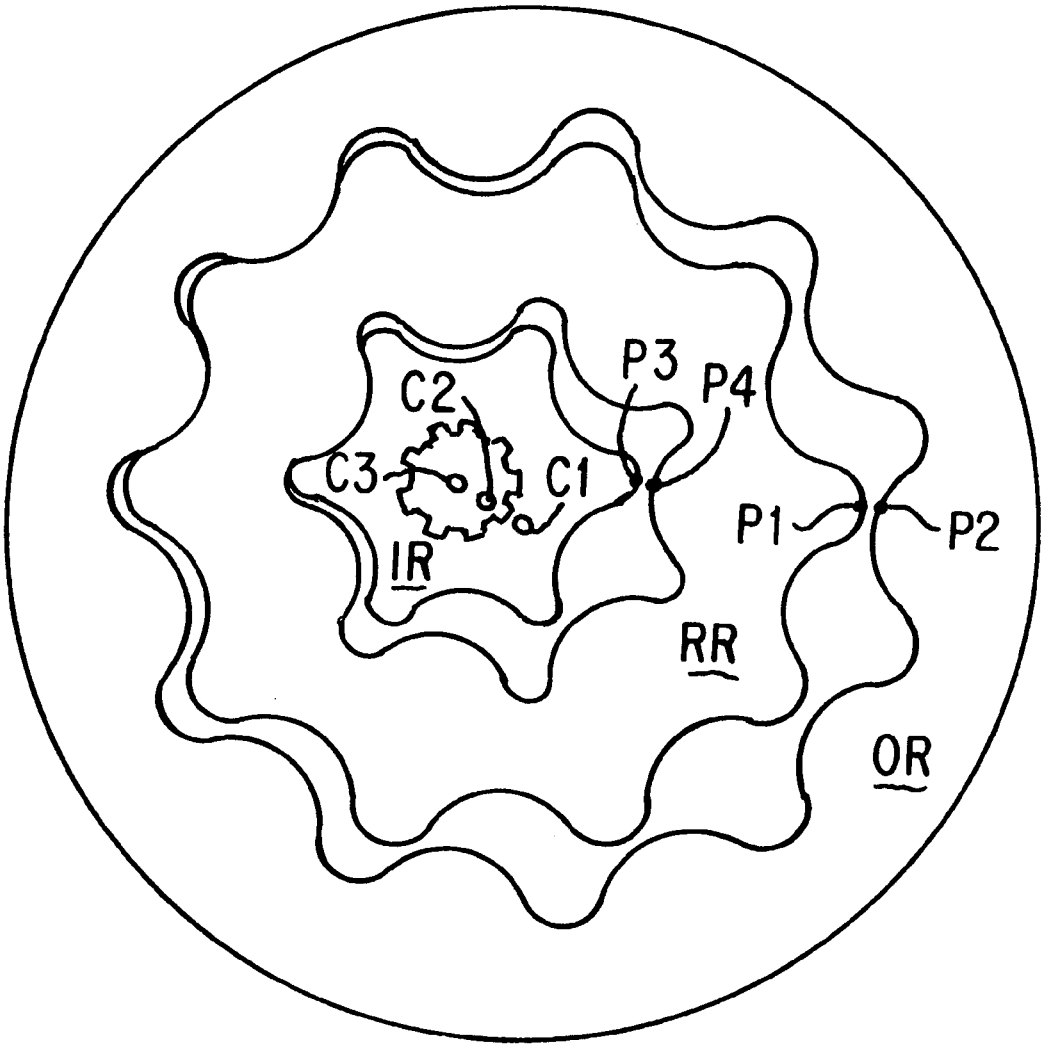
FIG. 10 illustrates centers C1, C2, and C3, about which respective rotors OR, RR, and IR rotate.

In operation, outer rotor OR rotates about center C1 in FIG. 10, as indicated by the arrow pointing to C1. Ring rotor RR rotates about center C2, and inner rotor IR rotates about center C3, both as indicated by arrows.

In actuality, the ring rotor RR would be sized so that point P1 would contact point P2, and the contact would act as a seal. Similarly, point P3 would contact point P4, for the same reason. However, for ease of generating drawings, in order to show the rotation which will now be discussed, these points P1 and P3 are shown separated from points P2 and P4.

Figure 11:
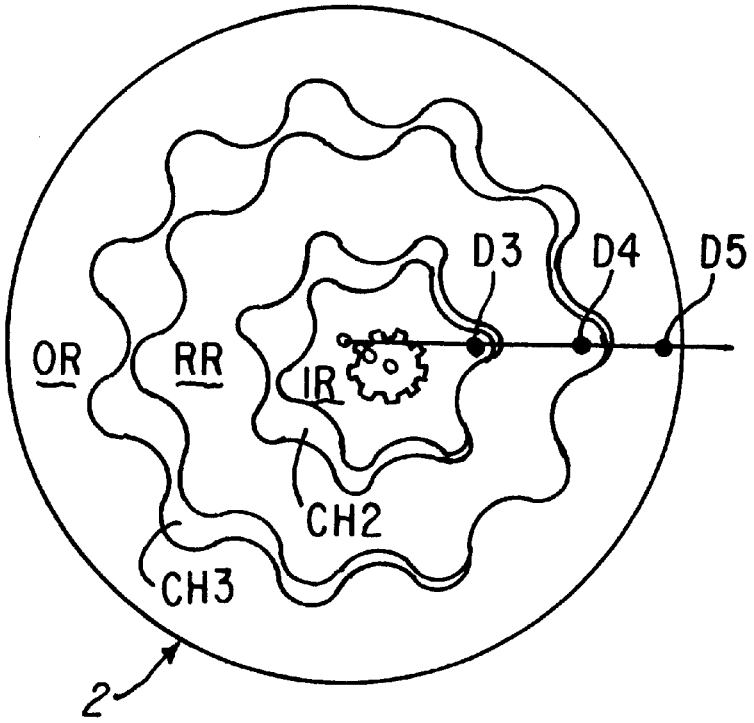
FIGS. 11–18 illustrate a sequence of events occurring during rotation of the invention.
Figure 12:
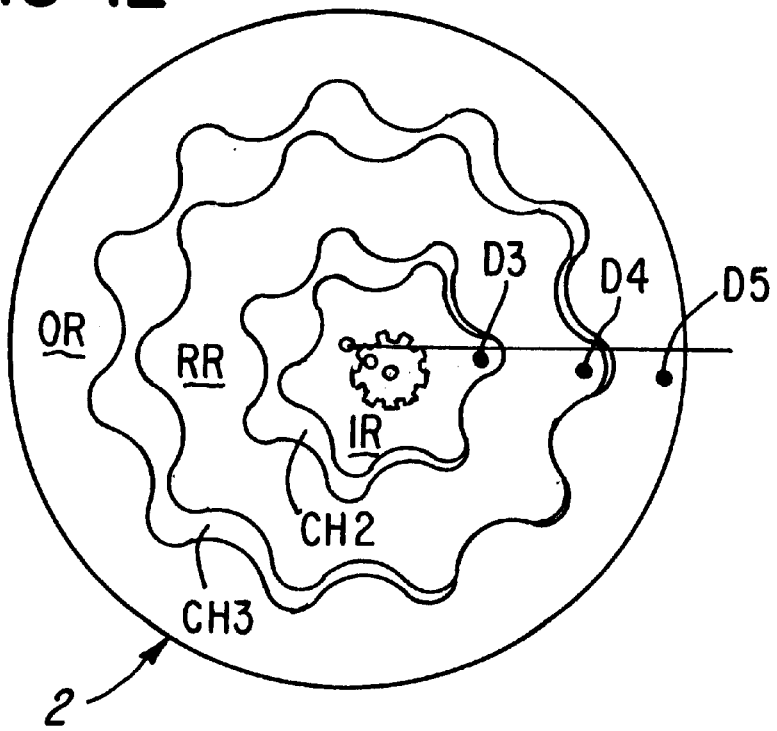
Figure 13:
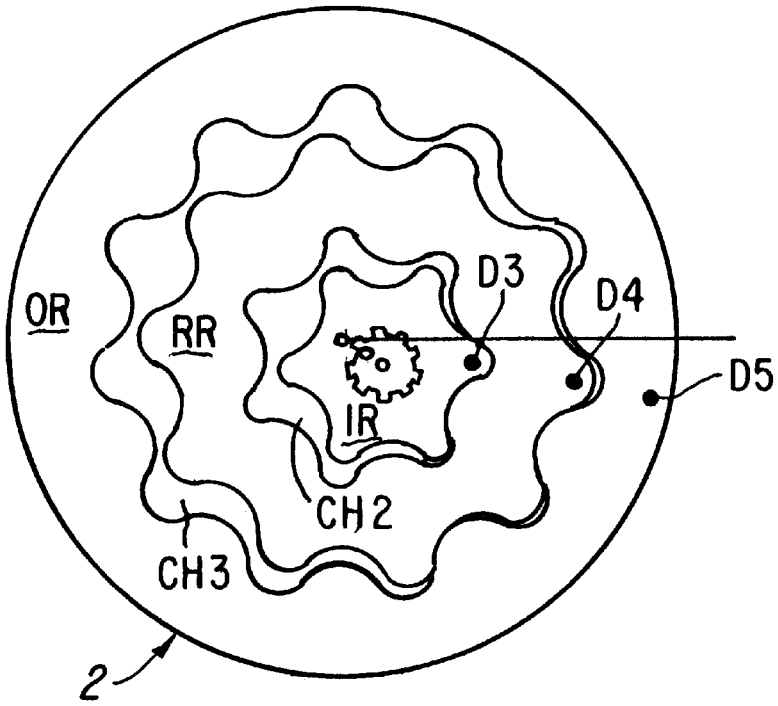
Figure 14:
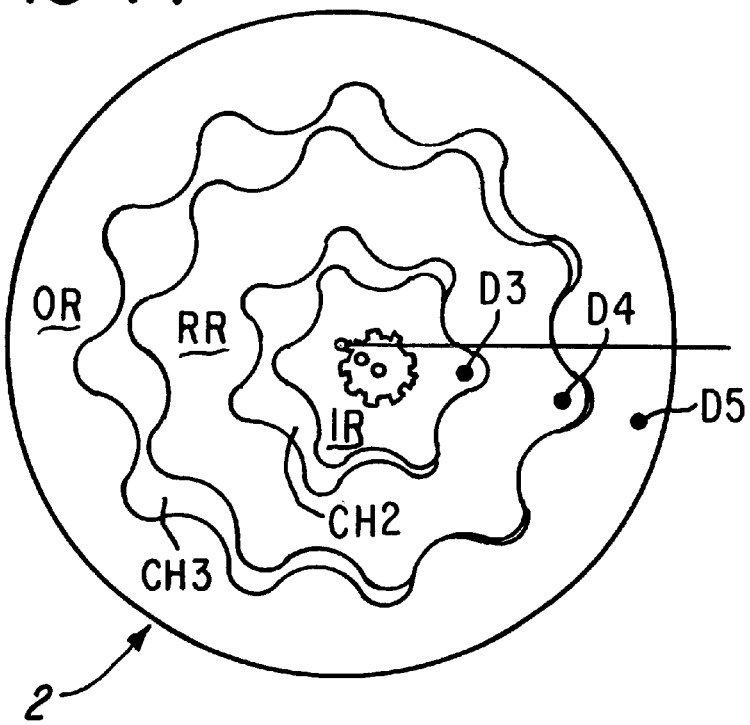
Figure 15:
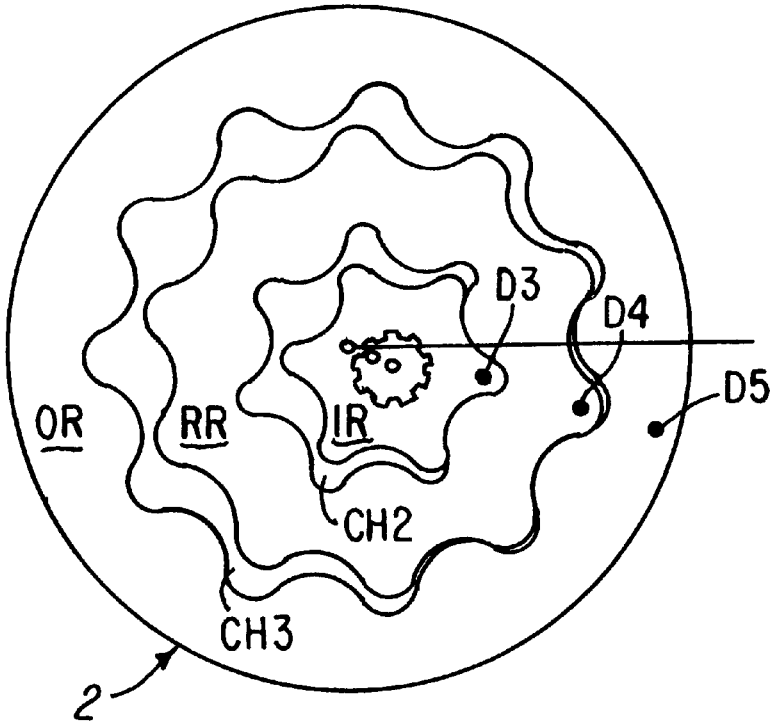
Figure 16:
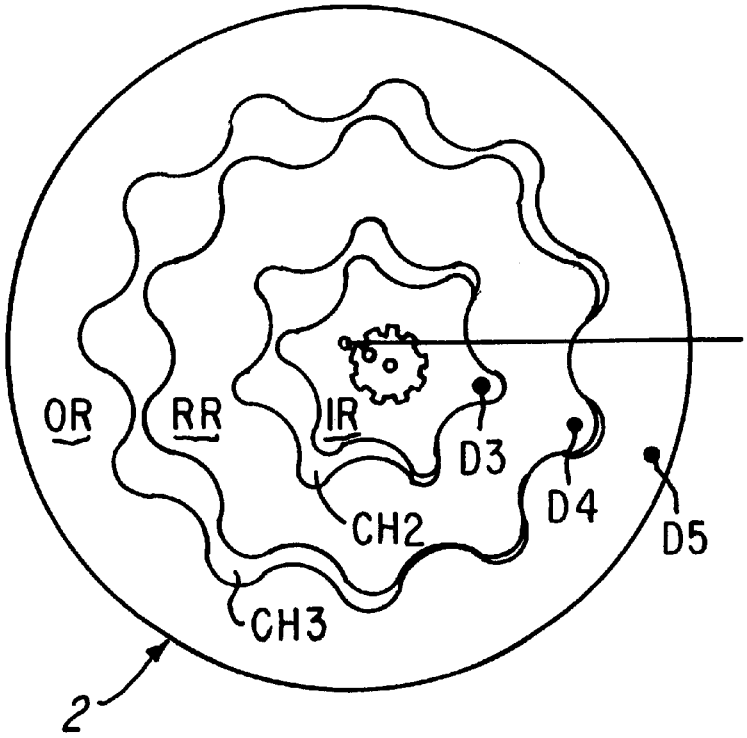
Figure 17:
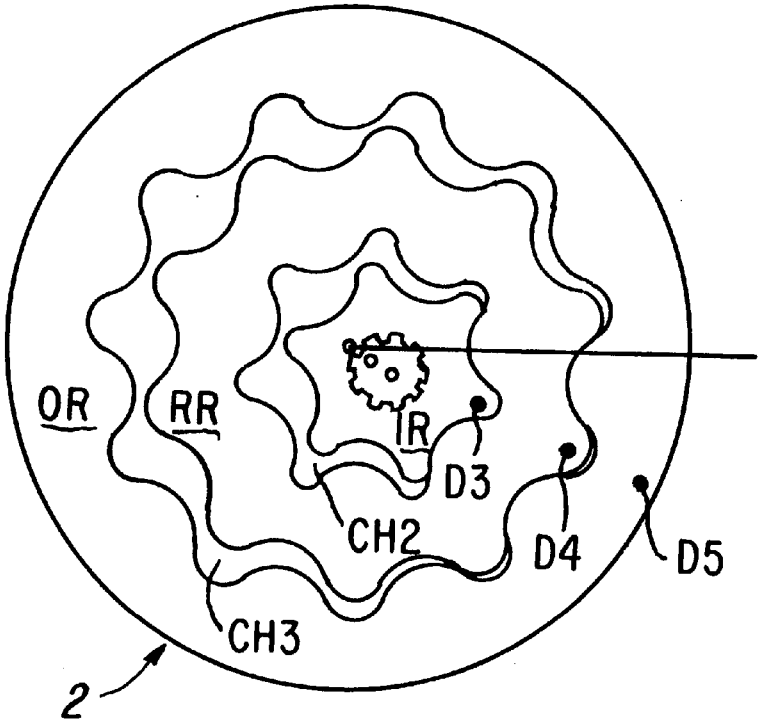
Figure 18:
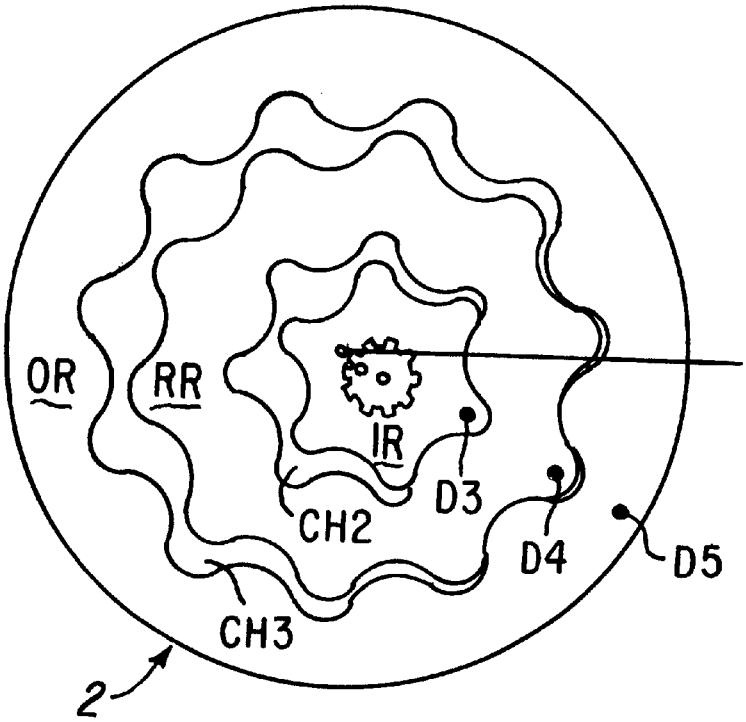

Operation as a motor will now be explained. FIG. 11 illustrates the starting position. Pressurized fluid is injected into chambers CH2 and CH3, through the ports HP1 and HP2 in plate 37 in FIGS. 8 and 9. In FIG. 11, reference dots D3, D4, and D5 are added.

The pressurized fluid causes all rotors to rotate about their respective centers shown in FIG. 10, as the sequence of FIGS. 11 through 18 indicates. The ratios of rotation are in proportion to the tooth ratios, and are 6/7 and 10/11. Thus, for every 7 revolutions of inner rotor IR, the ring rotor RR undergoes 6 revolutions with respect to the inner rotor IR. Similarly, for every 11 revolutions of ring rotor RR, the outer rotor RR undergoes 10 revolutions. Overall, a speed reduction occurs from inner rotor IR to outer rotor OR, in the ratio $(6/7)\times(10/11)$.

Figure 19:
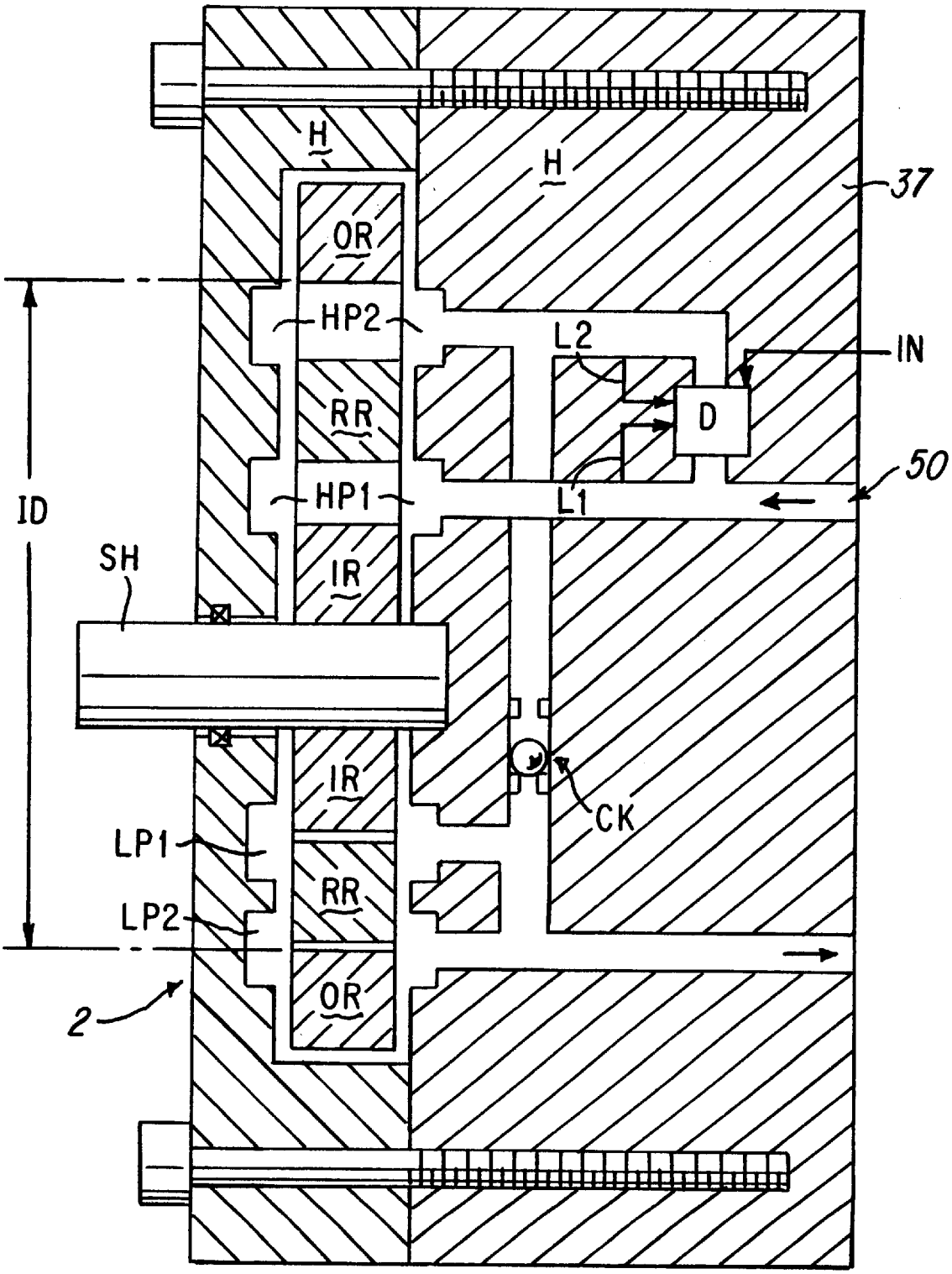
FIG. 19 is a cross-sectional schematic view of the invention of FIG. 10.

FIG. 19 is a schematic cross-sectional view of the apparatus of FIG. 8. Wall 37 is not a flat plate, but contains fluid conduits, and other apparatus. The motor operates under two speed conditions, using a single pressure source (not shown), applied to line 50. For high speed of shaft SH, displacement valve D is closed, thereby causing hydraulic fluid to be applied to port HP1 exclusively. Both rotors IR and OR rotate as shown in FIGS. 11–18, and at a relatively high speed and high pressure drop across the motor 2. This is called "single-displacement" mode.

A check valve CK is used during single-displacement mode. At this time, gear set S2 in FIG. 9 is not used as a motor, so that set operates as a pump. The check valve CK allows oil being pumped by set S2 to flow in a continuous loop from outlet LP2 to inlet HP2, and at low pressure.

For relatively low speed of shaft SH, displacement valve D opens, based on a pressure differential sensed on lines L1 and L2 (or other measured parameter, such as engine speed, radiator fluid temperature, vehicle speed, and so on), and applies pressurized fluid to both ports HP1 and HP2. The same rotation occurs as shown in FIGS. 11–18, but now at a lower speed and with the same flow rate. That is, the same relative rotation of the three rotors IR, RR, and OR occurs, at the same ratio as before, namely, (6/7) and (10/11), but now at a lower speed, and lower pressure drop across the motor 2. This is called "dual-displacement" mode. Check valve CK is closed.

Figure 20:
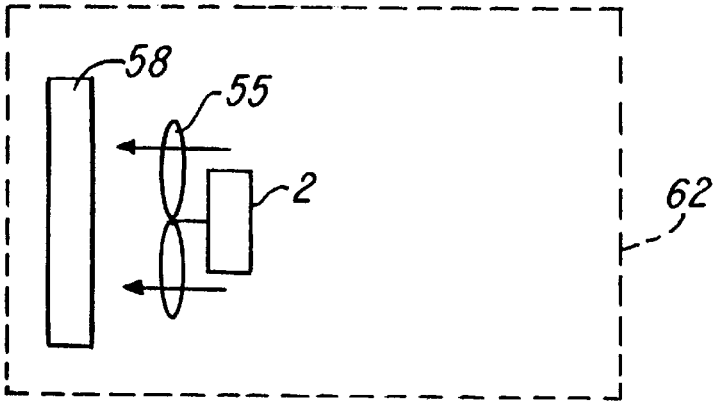
FIG. 20 illustrates one embodiment of the invention, wherein block 58 represents a radiator in a motor vehicle.

In one embodiment, the motor 2 in FIG. 20 is used to drive a fan 55 to cool a radiator 58, used in an automotive vehicle 62. Pressure is applied by an engine-driven pump (not shown), and the pressure reaching the motor 2 is controlled by a regulator (also not shown). The regulator provides the desired pressure to the motor. Such pumps and regulators are known in the art.

At low engine speeds, as in slow traffic, large cooling from fan 55 is required, so single-displacement mode is used, to provide high-speed operation of motor 2, at relatively high fluid pressure. At high engine speeds, as in highway driving, incoming ram air is sufficient to cool the radiator 58, so that low-speed operation of motor 2 is desired. Dual-displacement mode is used, to provide low-speed operation of motor 2, at relatively low fluid pressure.

Other modes of operation are contemplated. For example, at engine idling speeds, the motor 2 can operate in either single or dual-displacement mode, depending on the cooling requirements. As another example, when the vehicle tows a trailer, a high fan speed and pressure during dual displacement may be required, such as 3500 rpm at 1400 psi.

The selection between low- and high-speed operation is, as explained above, determined by displacement valve D in FIG. 19. That valve can be controlled by a signal on an input line IN. Alternately, the fluid supplied on line 50 can be provided by a hydraulic pump which is driven by the engine (not shown) of the vehicle 62. The flow on line 50 will be closely proportional to the speed of the engine.

Thus, at low engine speeds, the valve D is designed to remain closed, thereby providing high speed of motor 2. As engine speed increases, the pressure in line L1 will increase. When the differential reaches a threshold, the valve D opens, thereby providing low speed of motor 2.

It should be understood that the preceding discussion illustrates a specific embodiment of the invention, and that other modes of operation can be implemented.

Two examples of the two modes of operation are the following. The motor 2 is designed such that, in dual-displacement mode, it displaces 0.6 cubic inch per revolution, written as 0.6 cu. in./rev. In single-displacement mode, it displaces 0.25 cu. in./rev.

One gallon of fluid occupies 231 cubic inches. Thus, two gallons occupy 462 cubic inches. For the motor 2 to consume two gallons per minute in single-displacement mode, 1848 revolutions per minute (rpm) are required: 462/0.25=1848. For the motor 2 to consume the same two gallons in dual-displacement mode, 770 rpm are required: 462/0.60=770.

Thus, for a given flow rate, two speeds are possible, by selecting between single- and dual-displacement modes. Further, in each mode, modulation is possible, by modulating the pressure applied to the motor.

The ratio of these two speeds is roughly two: 1848/770 or 2.4 to 1. If a fixed, single-displacement pump, of the prior art type, were used, then, to accomplish this change in speed, a corresponding change in displacement would be required. That is, if rotation at 770 rpm required two gallons per minute, then rotation at 1848 would require 2.4×2 gallons per minute. The invention eliminates this requirement.

It is a fact that, in motor 2, torque produced equals displacement*pressure/constant, where the constant is 75.4. Adding units:

torque (lb. ft.)=displacement (cu. in./rev) * pressure (psi). For a pressure of 1,000 psi, the torques produced by single- and dual-displacement modes are the following:

dual: 0.6 * 1,000/75.4=7.95 lb. ft.

single: 0.25 * 1,000/75.4=3.31 lb. ft.

Alternate Embodiments

Figure 21A:
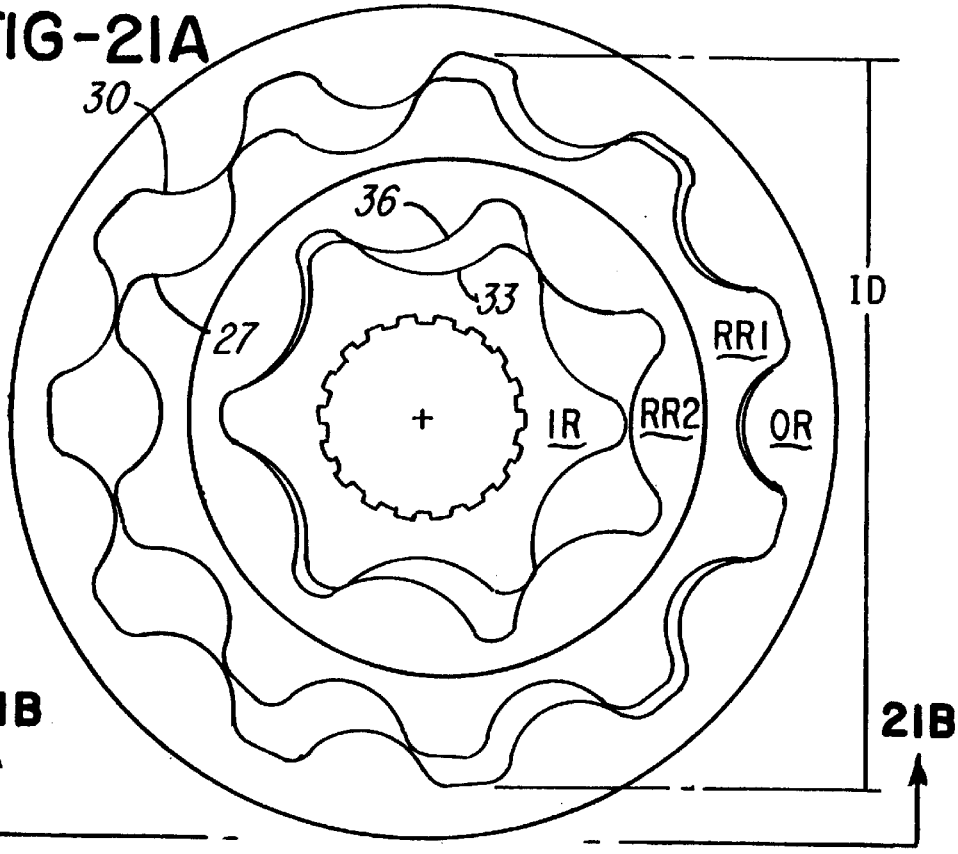
FIG. 21A illustrates another form of the invention.
Figure 21B:
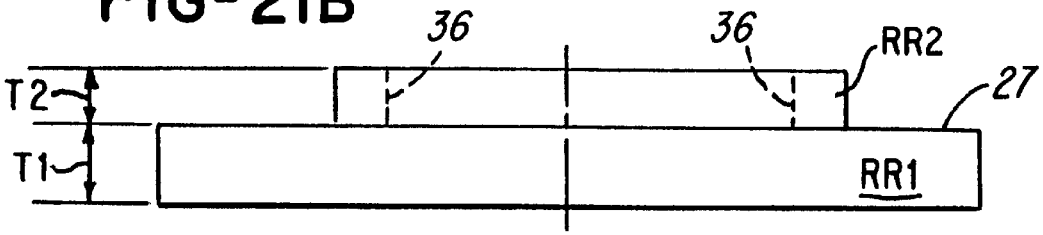
FIG. 21B is a view taken along the line 21B—21B in FIG. 21A.

The two gear sets S1 and S2 may be constructed of four distinct gears, as shown in FIGS. 21A and 21B. The gears 27 and 36 are not carried by a single ring rotor RR as in FIG. 8, but take the form of separate gears RR2 and RR1 in FIGS. 21A and 21B, bottom. The axial thicknesses T1 and T2 of the two pairs are shown, and need not be the same.

Figure 22:
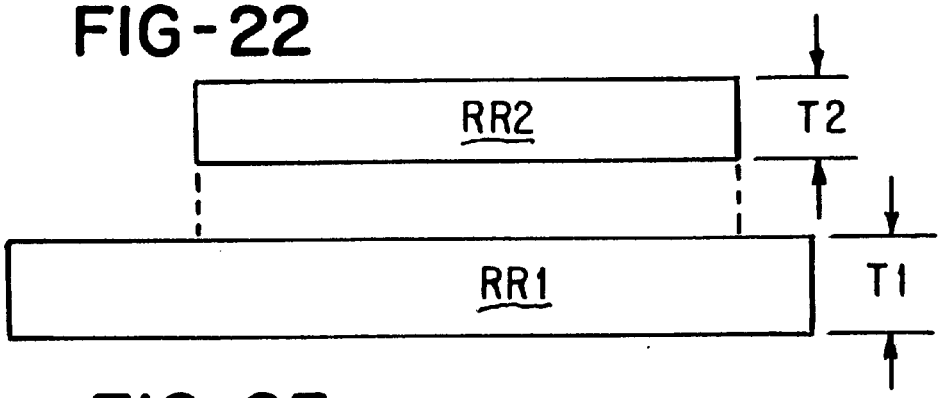
FIGS. 22–25 illustrate other forms of the invention.
Figure 23:
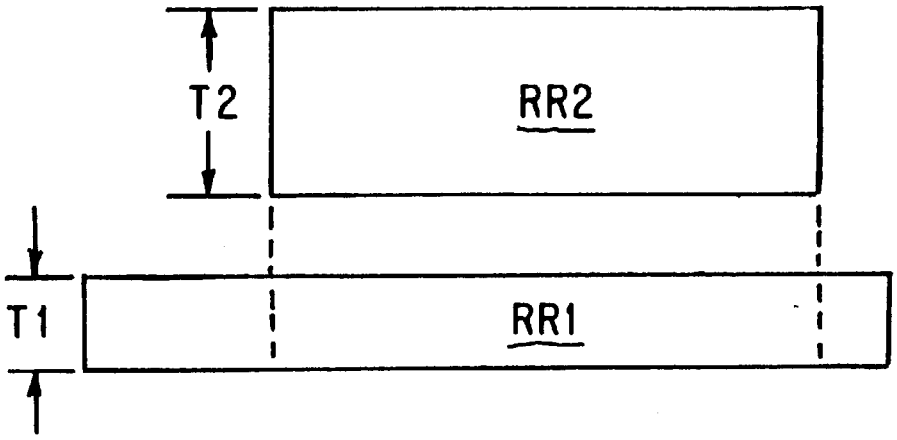
Figure 25:
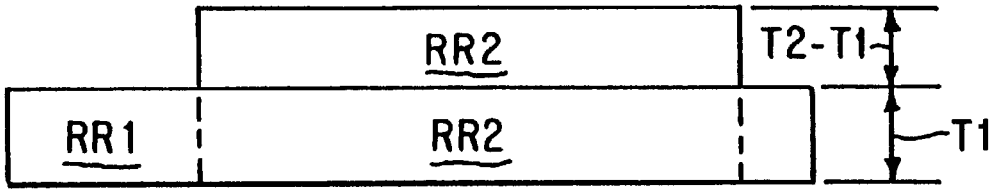
Figure 26:
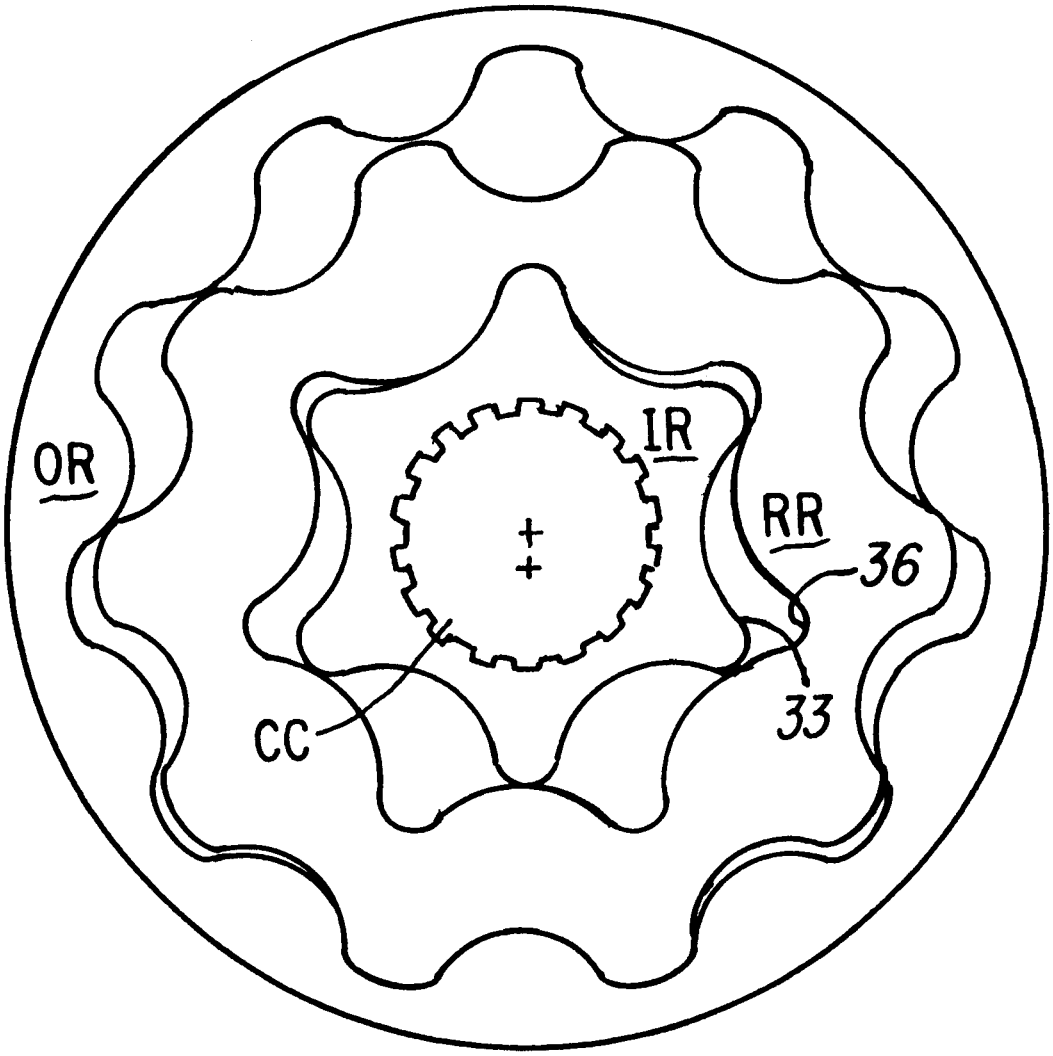
FIG. 26 illustrates another form of the invention.

For example, in FIG. 22, the gear RR2 is physically separate from gear RR1, and rests upon RR1 as indicated by the dashed lines in FIG. 22. Alternately, gear RR2 may occupy two axial regions, as shown in FIG. 23. When inserted into gear RR1, gear RR2 may occupy the axial thickness T1, and also extend beyond T1 by the difference (T2–T1), as shown in FIG. 25.

Figure 24:
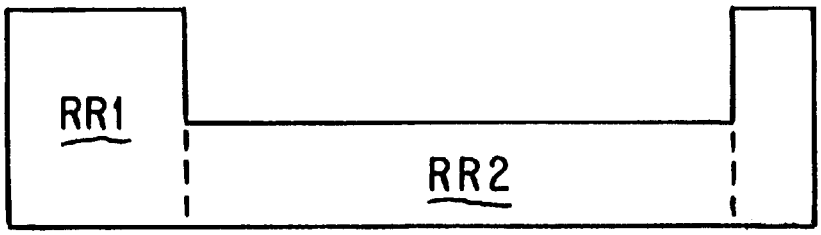

It may be desirable to make gear RR1 thicker than RR2, as shown in FIG. 24.

Inner gear RR2 may be constructed in a single piece, reducing the number of gears from four to three.

Additional Considerations

1. The volume between the pair of gears 27 and 30 in FIG. 8, which is displaced per revolution of rotor RR (with respect to rotor OR), depends on the shapes of the gear teeth, and is controllable. Similarly, the volume between the pair of gears 33 and 36, which is displaced per revolution of rotor IR (with respect to rotor RR), depends on the shapes of the gear teeth, and is also controllable.

In one embodiment, these volumes are designed to be identical. In another embodiment, the volumes are 0.3 cubic inch between gears 27 and 30, and 0.2 cubic inch between gears 30 and 33.

In another embodiment, the volume between the inner gears 36 and 33 is larger than that between gears 27 and 30. The physically larger gerotor pair displaces a smaller volume.

2. The invention of FIG. 20 provides a significant savings in energy, compared with other approaches. For example, one set of calculations shows that, if motor 2 delivers about 7 horsepower, then about 14 horsepower in hydraulic fluid is required to be delivered to motor 2. That is, the motor 2 consumes 14 horsepower, and delivers 7 horsepower, for an efficiency of 50 percent. The efficiency exceeds 40 percent.

In contrast, clutch fans driven by the engine (not shown) are in widespread use to perform the function of motor 2. Many of them consume about 30 horsepower, in order to deliver the same engine cooling capability. The efficiency is less than 25 percent.

3. The pressure ratio HP1/LP1 need not be the same as the ratio HP2/LP2; the pressure ratios may be different. Further, the pressures at ports HP1 and HP2 may be different.

4. The invention can be used either as a motor or a pump. In motor operation, fluid pressure is converted into torque. In pump operation, torque is converted into fluid pressure. In both cases, a transfer between pressure and torque occurs.

Figure 5:
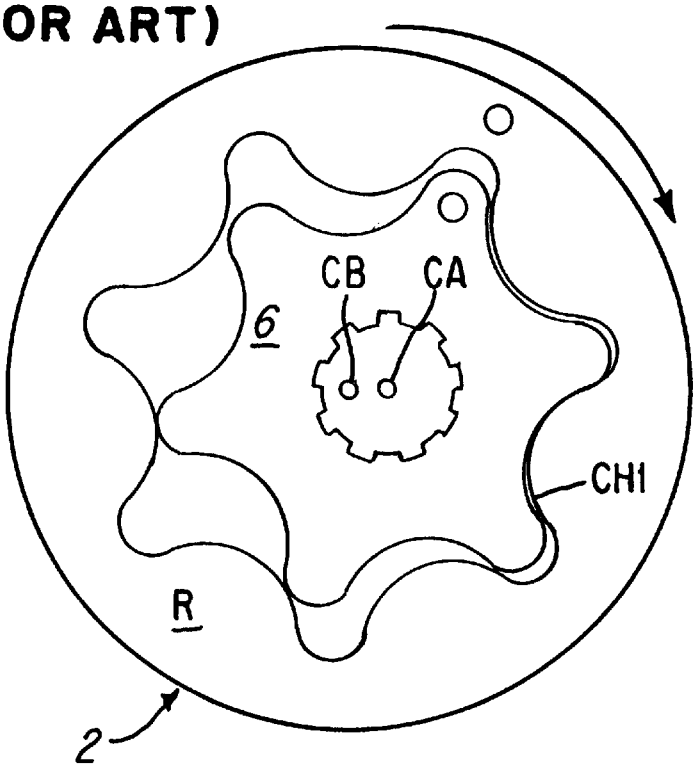
FIG-5 (PRIOR ART)
Figure 6:
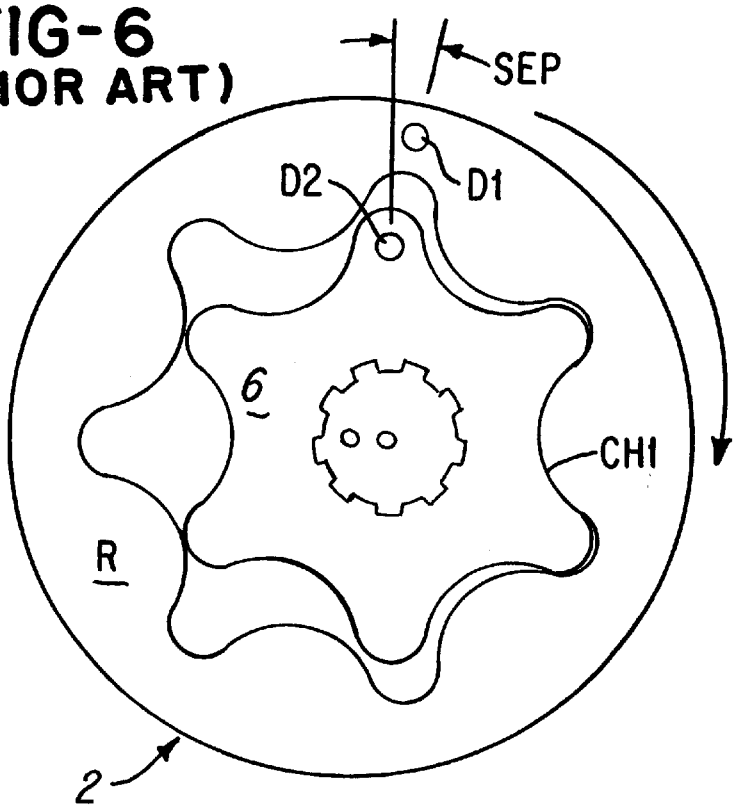
FIG-6 (PRIOR ART)
Figure 7:
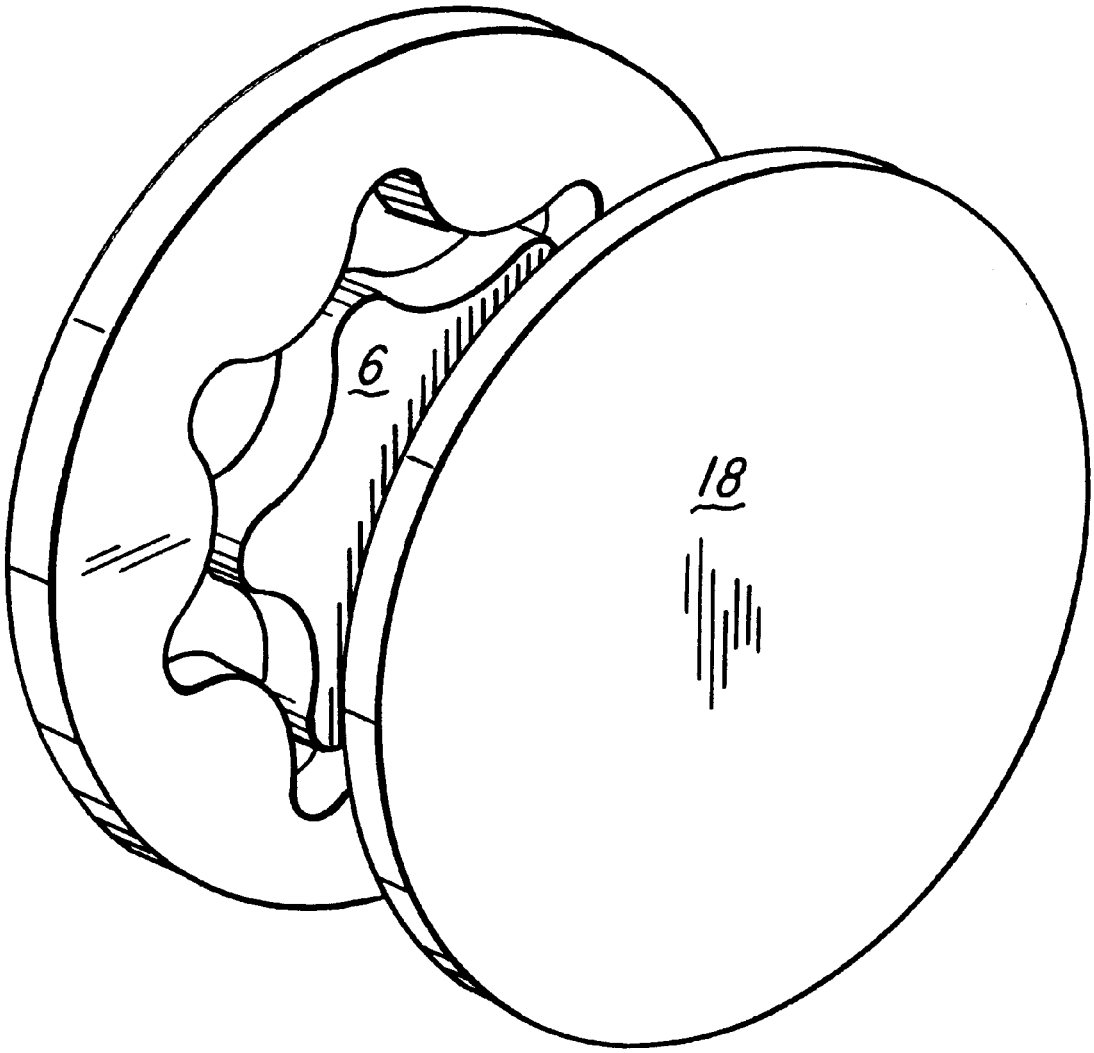
FIG-7 (PRIOR ART)
FIG. 7 is a prior art figure illustrating a wall 18, which is part of a housing (not shown) containing the motor 2.

In addition, in some instances, dual operation can occur. For example, gear set S1 in FIG. 5 can act as a motor, and gear set S2 can act as a pump. In this case, port HP2 becomes a low-pressure port, and port LP2 becomes a high-pressure port.

The invention should be distinguished from gear systems, such as planetary gear systems, which contain lubricants. Because of factors such as viscosity and other fluidic effects, the lubricant exerts some forces upon the gears, and the gears also exert forces upon the lubricant. It could be said that a transfer between pressure and torque occurs.

However, any transfer of this type is of minor significance. No significant conversion between torque and these pressures occurs. "Significant" refers to a conversion rate exceeding 25 percent, so that, for example, over 25 percent of the energy contained in a given volume of fluid is converted into torque.

5. In FIG. 8, the rotors IR, RR, and OR contain axial faces A, which face in the axial direction (as viewed in FIG. 8), that is in the direction axis 51 extends. Plate 37, when assembled to the motor, has a face F which is parallel to, and adjacent, the axial faces A.

6. FIG. 10 shows two pairs of gears: pair 27 and 30, which have 10 and 11 teeth, respectively, and pair 33 and 36, which have 6 and 7 teeth respectively. The tooth difference in each pair is one.

7. The rotors in FIG. 8 are substantially coplanar, and rotate about centers which have eccentricity, with respect to each other.

8. Gerotors are commercially available. The following U.S. patents, assigned to Sumatomo Electric Company of Japan, describe approaches to designing gerotors, and are hereby incorporated by reference: U.S. Pat. Nos. 4,504,202, 4,673,342, 4,657,492, 4,518,332. In addition, Sumatomo Electric designs gerotor motors and pumps to meet specifications provided by a purchaser.

9. The invention provides a "dual-displacement" hydraulic machine. One definition of "dual-displacement" is that, for a given machine speed, two selectable flow rates of fluid through the machine are available. Other definitions are possible.

10. During both single and dual-displacement operation, the speed of motor 2 is infinitely variable between its minimum and maximum limits.

Numerous substitutions and modifications can be undertaken without departing from the true spirit and scope of the invention. What is desired to be secured by Letters Patent is the invention as defined in the following claims.

What is claimed is:

1. A cooling system for an automotive vehicle, comprising:

a) a fan; and b) a dual-displacement hydraulic motor driving the fan, said dual-displacement hydraulic motor comprising a switch for switching said dual-displacement hydraulic motor between:

i) a low-displacement mode in which a given flow rate causes a relatively high motor speed; and ii) a high-displacement mode in which the given flow rate causes a relatively low motor speed;

said dual displacement hydraulic motor further comprising:

a first gerotor;

a second gerotor that is substantially coplanar with said first gerotor, said first and second gerotors being coupled to a common drive shaft that is coupled to said fan;

said first gerotor rotating about a first axis and said second gerotor rotating about a second axis, wherein said first axis is offset from said second axis;

wherein said switch controls hydraulic fluid in said hydraulic motor to switch between one of said first or second gerotors to both of said first and second gerotors when it is desired to drive said fan between said relatively high motor speed and said relatively low motor speed, respectively.

2. System according to claim 7, and further comprising means for selectively adjusting pressure or flow delivered to the motor in each mode.

3. The cooling system as recited in claim 1 wherein said system further comprises:

a modulator for modulating the pressure applied to said dual-displacement hydraulic motor.

4. The cooling system as recited in claim 1 wherein said first gerotor comprises a first thickness and said second gerotor comprises a second thickness; said first and second thickness being the same.

5. The cooling system as recited in claim 1 wherein said first gerotor comprises a first thickness and said second gerotor comprises a second thickness; said first and second thickness being different.

6. The cooling system as recited in claim 1 wherein said switch is a displacement valve which directs fluid to either one or both of said first and second gerotors when high or low cooling, respectively, by said fan is desired.

7. The cooling system as recited in claim 1 wherein said first and second gerotors comprise three distinct gears.

8. The cooling system as recited in claim 1 wherein said first and second gerotors comprise four distinct gears.

9. The cooling system as recited in claim 1 wherein said dual displacement hydraulic motor generates at least 3.31 lb. ft. torque during said high-displacement mode.

10. The cooling system as recited in claim 1 wherein said dual displacement hydraulic motor generates at least 7.95 lb. ft. torque during said low-displacement mode.

* * * * *